US005791170A

United States Patent [19]

Officer

[11] Patent Number: 5,791,170

[45] Date of Patent: Aug. 11, 1998

[54] PORTABLE LOCKING DEVICE

[76] Inventor: David Ernest Officer, 2 Elm Street, Medindie, South Australia, 5081

[21] Appl. No.: 737,465

[22] PCT Filed: May 17, 1995

[86] PCT No.: PCT/AU95/00295

§ 371 Date: Nov. 15, 1996

§ 102(e) Date: Nov. 15, 1996

[87] PCT Pub. No.: WO95/31625

PCT Pub. Date: Nov. 23, 1995

[30] Foreign Application Priority Data

May 17, 1994 [AU] Australia ..... PM5654

[51] Int. Cl.[6] ..... E05B 67/06

[52] U.S. Cl. ..... 70/49; 70/14; 70/19

[58] Field of Search ..... 70/30, 49, 14, 70/18, 19

[56] References Cited

U.S. PATENT DOCUMENTS

| | | | |
|---|---|---|---|
| 351,063 | 10/1886 | McCormick | 70/49 X |
| 1,380,719 | 6/1921 | Johnson | 70/49 |
| 1,475,256 | 11/1923 | Belair | 70/49 X |
| 2,190,661 | 2/1940 | Hauer | 70/49 |
| 3,435,642 | 4/1969 | Del Pesco | 70/49 |
| 3,855,824 | 12/1974 | Falk | 70/49 X |
| 4,850,207 | 7/1989 | Ylven | 70/49 |
| 5,447,043 | 9/1995 | Hwang | 70/49 |
| 5,473,917 | 12/1995 | Say | 70/49 |
| 5,517,835 | 5/1996 | Smith | 70/49 X |
| 5,568,740 | 10/1996 | Lin | 70/49 |

FOREIGN PATENT DOCUMENTS

| | | | |
|---|---|---|---|
| 591712 | 4/1959 | Italy | 70/49 |

*Primary Examiner*—Suzanne Dino Barrett
*Attorney, Agent, or Firm*—Klauber & Jackson

[57] ABSTRACT

In one embodiment, a portable looped cable locking device for use with a cable for securing items, the device including a lock housing in which one end of the cable is arranged to be anchored, a cable receiving passageway extending through the housing and through which the other end of the cable is passed so as to form a closed retaining loop, a lock supported for rotation by the housing, an eccentric positioning cam on the lock and rotatable therewith, a cable clamping member having a cable gripping portion on an outer surface thereof, and an inner peripheral surface which defines a cam following opening, the clamping member being mounted for bodily and rotational movement within the housing between at least one locked position, wherein the cable gripping portion frictionally engages with and locks the cable against withdrawal from the passageway, wherein loosening of the closed retaining loop is prevented, and, optionally, wherein tightening of the closed retaining loop is prevented, and an unlocked position wherein the cable gripping portion is disengaged from the cable and the cable is free to move through the passageway, the clamping member being rotationally unrestrained by the cam.

17 Claims, 2 Drawing Sheets

Figure 1A:
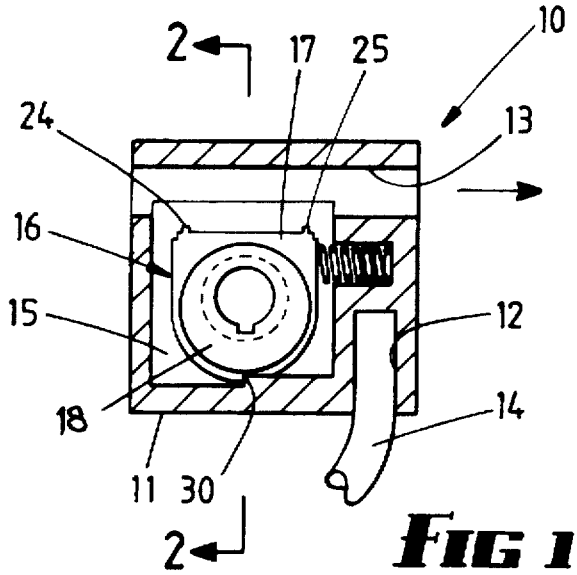

41"
17
18
19
53
25
41'
20
21
45
51
46
40
47
43
48
10
50
27
5
44
4
49
31
30
18
11
42

41'
51
43
41
42
40
41"
47
46
42

PORTABLE LOCKING DEVICE

This invention relates to an improved portable locking device, in particular to a portable looped cable locking device of the type described and illustrated in Australian Patent No 587718 issued to one of the present applicants.

In practice, we have discovered that the portable looped cable locking device described and illustrated in our Australian Patent 587718 is not generally satisfactory in that it operates only as a two position lock, namely a locked position where the cable is locked against movement in either direction through its cable receiving bore which extends through the housing of the locking device, and an unlocked position where the cable can slide freely in either direction through the bore to vary the size of the loop. Thus, in some instances, it is awkward to adjust the size of the loop and to tighten the looped cable around an object since one must release his or her grip on the free end of the cable in order to actuate the lock key to lock the locking device, which may result in a loss of tension. A still further disadvantage is that it was difficult to effectively lock articles where a small sized loop is required.

It is the main object of the present invention to provide an improved portable looped cable locking device which obviates one or both of the aforementioned disadvantages, which is of simple construction, of low cost, and which may be operable only with a key.

According to one form of this invention therefore, a portable looped cable locking device for securing items, eg skis, stocks, cycles etc, to a rack, bar or post or like fixture, comprises a housing in which one end of the cable is arranged to be anchored, a cable receiving passageway extending through the housing and through which the other end of the cable is passed so as to form a loop, a lock supported for rotation by said housing, a ring-shaped clamping member movably mounted within the housing and having a cable gripping portion on an outer surface thereof, the inner periphery of said clamping member defining a cam mounting opening, an eccentric positioning cam on said lock and rotatable therewith, said cam being disposed in said opening so that, upon rotation of the lock, the eccentric cam and clamping member co-operate to alter the angular disposition of said cable gripping portion between a first unlocked position where the cable gripping portion is positioned clear of said passageway and the cable is free to move in either direction through said passageway, and a second ratchet locking position where the cable gripping portion is tilted relative to said passageway with a portion thereof grippingly engaging a portion of the cable passing through said passageway in a manner so as to allow movement of the cable in the tightening direction only, and spring means for biassing said clamping member in the direction of its ratchet locking position.

Most preferably, the clamping member is a portable looped cable locking device wherein said clamping member is movably mounted for movement from said first unlocked position, to said second ratchet locking position, and in turn to a third fully locked position where said cable gripping portion is disposed approximately parallel to said passageway and clampingly engages against the cable and locks same against movement in either direction along said passageway.

Preferably, the clamp member comprises a circular cam wheel or disc eccentrically mounted for rotation about the axis of the lock cylinder of a key operated lock means, the rotation of the cam wheel effecting bodily rocking movement of the clamp member between its various positions.

Preferably, the clamp member is provided with a U-shaped cable locating bed in which the cable locates when threaded through said passageway, the base of said U-shaped bed being provided with a pair of lengthwise spaced apart ridge-like projections, both of which, when the clamp member is in its fully locked third position, clampingly engage against respective portions of the cable in order to frictionally lock same against any movement, whilst when the clamp member is in its ratchet locking position, only one of the ridge like projections clampingly engages against the cable.

Preferably, the ratchet action of the clamp member is controlled by means of a coil spring acting between one side of the clamp member near said U-shaped bed and an internal wall of a chamber formed in the housing.

Preferably, the anchored end of the cable is retained within a rotary plug or swivel member rotatably housed within said housing at a location spaced lengthwise from said lock, said plug having a relatively short passageway extending therethrough, said short passageway being arranged to register with a first opening in the peripheral wall of the housing and through which the cable is fed in order to thread the cable through the plug, and also with a slot-like opening formed in the peripheral wall of the housing and spaced circumferentially from said first opening. Preferably said first opening also communicates with the exit end of said main passageway.

With this arrangement, the anchored end of the flexible cable is able to bodily rotate about an axis transverse of the housing and permits a very small sized loop to be formed for tightening around an object to be secured.

Preferably, the lock is designed so that the key can be inserted or withdrawn only when the clamp member is in its fully unlocked or locked positions. With such an arrangement the cable cannot be inserted without first unlocking the unit. This renders the unit totally inert without the key and of course facilitates the operation of the device during the locking step.

Figure 2:
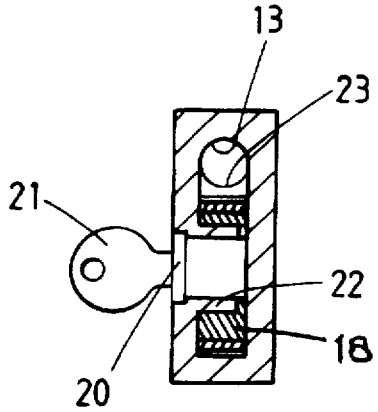
Figure 1B:
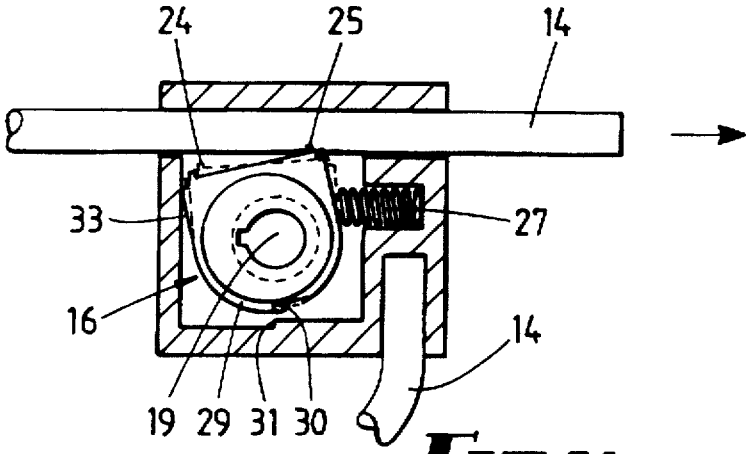
Figure 1C:
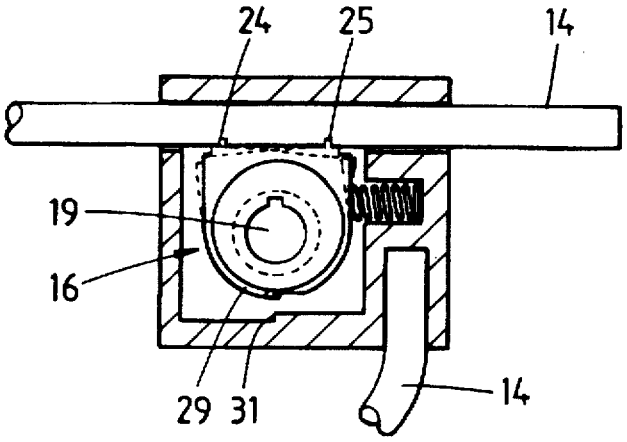
Figures 3, 4, 5:
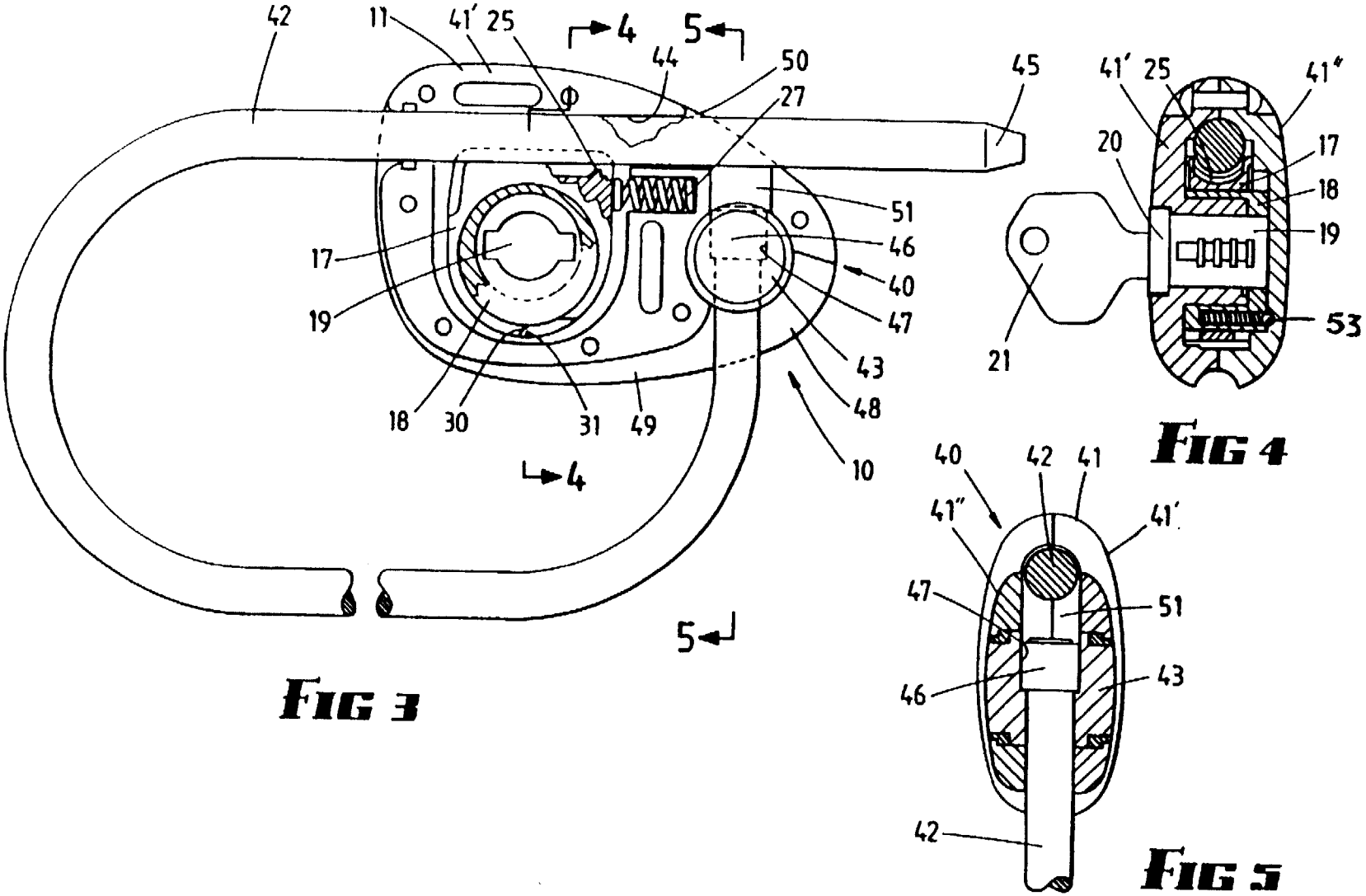

In order to more fully explain the present invention, several embodiments are described hereunder in some further detail with reference to and as shown in the accompanying drawings wherein:

FIGS. 1(*a*) to 1(*c*) schematically illustrate a cable locking device according to a first embodiment in unlocked, partly locked and fully locked positions respectively;

FIG. 2 is a sectional view taken along the line 2—2 shown in FIG. 1(*a*); FIG. 3 is an elevational view, partly sectioned, of a cable locking device according to a second embodiment of the invention; FIG. 4 is a sectional view taken along the line A—A shown in FIG. 1; whilst FIG. 5 is a sectional view taken along the line B—B shown in FIG. 1.

Referring to FIGS. 1(*a*) to (*c*) and FIG. 2 of the drawings, a portable looped cable locking device 10 comprises a housing 11 preferably formed of two mating halves of either metal or plastics material, which is provided with a closed bore 12 extending inwardly from one side of the housing 11 and a cable receiving through-bore 13 which extends between opposite ends of the housing 11. In this embodiment, one end of a cable 14 is anchored in bore 12, whilst the other end of the cable 14 is passed through bore 13 so as to form a loop around an article to be secured, the size of the loop being adjusted by simply pulling the free end of the cable 14 through the bore 13.

The housing 11 is formed with a chamber 15 which houses a cable clamp mechanism 16 which comprises an outer tiltable ring-shaped clamp member 17 having a circular opening formed therein, an inner cam wheel or disc 18 rotatably mounted within the circular opening of clamp member 17, the cam wheel 18 being eccentrically mounted on a rotor 19 and keyed thereto for rotation therewith. The rotor 19 is fast with the rotatable tumbler of a conventional pin tumbler cylinder lock 20 which is operated by a key 21 which, in this embodiment, can only be removed from the lock 20 when in the fully locked position (shown in FIG. 1(*c*)).

As shown in FIG. 2, the tumbler is journalled for rotation in a bearing sleeve 22 which projects into the interior of the chamber 15 and is integrally formed with the housing 11.

As shown in FIG.s 1(*a*) to (*c*) of the drawings, the device 10 has three different operational states, namely an unlocked position (FIG. 1(*a*)), a semi-locked or ratchet position (FIG. 1(*b*)) and a fully locked position (FIG. 1(*c*)). These positions are achieved by the positioning of the members 17, 18 relative to one another and relative to the cable 14 which passes through bore 13.

The upper or clamping end of clamp member 17 is formed with a U-shaped cable locating groove or recess 23 extending across the width thereof and aligned with passageway 13. Adjacent the ends of the recess 23 are tooth-like projections or ridges 24, 25 which grippingly engage against the cable 14, depending on the angular position of the clamping mechanism 16.

In the unlocked position, the clamp 17 and its cable engaging projections 24, 25 lie clear of the bore 13 and hence allow the cable 14 to be freely passed in either direction through the bore 13 (for example, to either enlarge or reduce the size of the loop). When the key 21, and thereby the rotor (or cylinder) 19, is rotated, the eccentric wheel or cam 18 also rotates to in turn bodily tilt the clamp member 17 relative to the passageway 13. In the ratchet position shown in FIG. 1(*b*), the cable 14 is gripped between the projection 25 and the upper wall of passageway 13 whilst the projection 24 remains clear of the cable. The ratchet action is achieved by means of a bias spring 27 which makes pressure contact against one side of the clamp 17 near its upper end and serves to hold the clamp in its tilted condition. In the ratchet position, cable 14 can be pulled outwardly in the direction of the arrow shown in FIG. 1(*b*) but cannot be moved in the opposite direction by virtue of the engagement between the projection 25 and cable 14. The spring 27 operates to return the clamp 17 to its gripping engagement with the cable 14, once the cable loop has been adjusted in size.

In the fully locked position shown in FIG. 1(*c*), both projections 24, 25 exert a vice like grip on the cable 14 and clamp same within the passageway 13 against movement in either direction.

To avoid the clamp member 17 being over tilted by the force of the spring 27, when the device is in the unlocked position (FIG. 1(*a*)), the peripheral wall 29 of clamp member 17 is provided with an axial shoulder 30 which cooperates with an abutment surface 31 on the bottom wall of the chamber 15, and when engaged therewith counteracts the force of the spring 27; Thus, when the lock 20 is rotated towards its unlocked position, the shoulder 30 abuts against the surface 31 just before the unlocked position is reached, further anticlockwise rotation of the lock causing the upper end of the member 17 to be displaced against the resistance of the spring 27 and assume an approximately upright position. When rotating the lock from its unlocked to the semi-locked (ratchet) and finally to its fully locked position, so as to avoid over tilt of the member 17 (which might cause the projection 25 to "dig" into the cable 14 to an extent that the eccentric wheel or cam 18 cannot then be fully rotated to the locked position as shown in FIG. 1(*c*)), the member 17 is arranged so that its surface 33 (refer FIG. 1(*b*)) is designed to engage a wall surface of the chamber 15 during the final stage of rotation from the ratchet to the fully locked position. Again, the engagement between surface 33 and the inner wall surface assist to "straighten" the member 17 without interfering with its locking action. In this embodiment, the engagement occurs during approximately the last 20° of rotation of the rotor 19.

Referring now to the second embodiment of the invention illustrated in FIGS. 3 to 5 of the drawings, the locking device 40 comprises a casing 41 formed of two mating halves 41', 41" secured together by rivets. A cable 42 has one of its ends anchored in a rotary plug 43 which is journalled for free rotary movement within transverse opening formed in the housing 41, the other or free end of the cable 42 being fed through a cable receiving passageway 44 extending through the housing 41 so as to form a loop around the object or item to be secured and a securement anchorage. The free end of the cable 42 is provided with a cap 45, whilst the other anchored end of the cable 42 is provided with an enlarged ferrule 46 which locates in a circular passageway 47 which extends through the plug 43. When the ferrule 46 is seated within the plug 43, the anchored end of the cable 42 is able to bodily rotate about the axis of the rotary plug 43, such rotational movement being assisted by an enlarged opening 48 in the housing 41 which leads to the passageway 47 as well as recessed portion 49 which extends along the lower side of the housing 41 and merges with opening 48. With this arrangement, the size of the loop formed by the cable 42 can be quite small. Of course it will be appreciated that in some instances, a small size loop will be required in order to effectively secure an item to a securement support.

The clamp mechanism housed within the housing 41 is essentially the same as that described in the previous embodiment illustrated in FIGS. 1(*a*)–(*c*) and 2 and hence an explanation of its operation need not be repeated. The same reference numerals are used to denote corresponding parts. The three different operational states of the key operated clamp mechanism are exactly the same.

As shown in FIG. 3, opening 50 in the wall of the housing 41 communicates with the exit end of the passageway 44 and also with inlet passage 51 which leads to the through-bore 47 of the rotary plug 43. Thus in this embodiment, the opening 50 serves both as an entry hole for the leading end of the cable 42 as well as an exit opening therefor, after having formed the loop.

Again, the key operated lock includes a pin tumbler cylinder lock 20 which carries at its inner end a rotor 19 which is keyed to the eccentric wheel or cam 18 which in turn is rotatably housed within the circular opening formed in the clamp member 17.

Preferably the cable 42 is formed of a bundle of steel wires protected by a PVC coating. A hemp or nylon core may be incorporated into the cable to ensure that it can bend around tight radii.

By virtue of the rotary plug or swivel 43 and the slot-like opening 48 in the housing, the anchored end of the cable can rotate through an arc of approximately 80° relative to the housing and can fully rotate about its own axis. This makes it easier for the device to be positioned against the object to be locked.

As shown in FIG. 4, a spring-loaded ball bearing 53 is housed in a blind bore formed in the cam 18 and releasably locates in a recess formed in the inner surface of the housing half 41", there being 3 such spaced apart recesses which correspond to the three different angular positions of the lock 20.

It should be appreciated that the present invention also encompasses a locking device produced so as to operate as a two position lock—ie having unlocked and ratchet locking positions only. There will be instances where the fully locked operational state of the clamping mechanism is not required.

A brief consideration of the above-described embodiments will indicate that the invention affords for an improved portable looped cable locking device which is effective in its operation, of simple construction, and aesthetically pleasing.

I claim:

1. A portable looped cable locking device for use with a cable for securing items, e.g. skis, stocks, cycles etc., to a rack, bar or post or like fixture, comprising:

a lock housing in which one end of the cable is arranged to be anchored, a cable receiving passageway extending through the housing and through which the other end of the cable is passed so as to form a closed retaining loop, a lock supported for rotation by said housing, an eccentric positioning cam on said lock and rotatable therewith, a cable clamping member having a cable gripping portion on an outer surface thereof, and an inner peripheral surface which defines a cam following opening, said clamping member being mounted for bodily and rotational movement within the housing between at least one locked position, wherein the cable gripping portion frictionally engages with and locks the cable against withdrawal from said passageway, wherein loosening of the closed retaining loop is prevented, and, optionally, wherein tightening of the closed retaining loop is prevented, and an unlocked position wherein the cable gripping portion is disengaged from the cable and the cable is free to move through said passageway, the clamping member being rotationally unrestrained by the cam, said cam being disposed in said cam following opening so that, upon rotation of the lock, the eccentric cam also rotates to in turn effect said bodily movement of the clamping member, relative to the cable receiving passageway, and spring means for biasing said clamping member in a rotational direction around the cam to urge said cable gripping portion into engagement with the cable.

2. The portable looped cable locking device according to claim 1, wherein said clamping member is movably mounted for bodily and rotational movement between said unlocked position and a ratchet locking position wherein the cable gripping portion is tilted relative to said passageway with a portion thereof grippingly engaging a portion of the cable passing through said passageway in a manner so as to allow movement of the cable in a tightening direction only.

3. The portable looped cable locking device according to claim 1, wherein said clamping member is movably mounted for bodily and rotational movement from said unlocked position, to a second ratchet locking position wherein the cable gripping portion is tilted relative to said passageway with a portion thereof grippingly engaging a portion of the cable passing through said passageway in a manner so as to allow movement of the cable in a tightening direction only, and in turn to a third fully locked position where said cable gripping portion clampingly engages against the cable and locks the cable against movement in either direction along said passageway.

4. The portable looped cable locking device according to either claim 2 or claim 3 wherein said cam is a circular cam wheel or disc, and said cam following opening is a circular hole formed in said clamping member.

5. The portable looped cable locking device according to claim 2 or claim 3, wherein said lock can be rotated only by a key insertable into the lock.

6. The portable looped cable locking device according to claim 5, wherein said key of the lock is removable when the clamping member is either in the unlocked or fully locked positions.

7. The portable looped cable locking device according to claim 3, wherein said cable gripping portion of the clamping member is U-shaped and extends longitudinally of said passageway and is provided with a pair of lengthwise spaced apart ridgelike projections, each of which, when the clamping member is in the fully locked third position, grippingly engages against a respective portion of the cable so as to frictionally lock the cable against any movement, whilst when the clamping member is in the ratchet locking position, only one of said ridge-like projections is in gripping engagement with the cable.

8. The portable looped cable locking device according to claim 2 or claim 3, wherein said lock is a tumbler cylinder lock having a rotor to which is keyed said eccentric cam.

9. The portable looped cable locking device according to claim 2 or claim 3, wherein said clamping member is provided with an engagement surface on the outer wall, remote from said gripping portion, and which is arranged to engage an internal abutment surface within said housing prior to the clamping member reaching the unlocked position, whereby further rotation of the lock towards the unlocked position causes the clamping end of the clamping member to be displaced against the resistance of the bias spring and assume an approximately upright position within the housing.

10. The portable looped cable locking device according to claim 2 or claim 3 wherein the anchored end of the cable is retained within a rotary plug or swivel member rotatably housed within said housing, said plug or swivel member having a bore extending therethrough, said bore being alignable with a first opening in the housing and through which the cable is fed in order to thread the cable through the plug, said housing having a further slot-like opening spaced from said first opening, said further slot-like opening communicating with the bore of the plug member.

11. The portable looped cable locking device according to claim 10, wherein said first opening also communicates with an end of said passageway.

12. The portable looped cable locking device according to claim 10, wherein said further slot-like opening merges with a grooved peripheral portion which extends along a side of the housing.

13. The portable looped cable locking device according to claim 2 or claim 3, wherein said housing is formed of two mating halves which are secured together.

14. A portable looped cable locking device for use with a cable having a leading end and a trailing end comprising:

a housing provided with:

a first, long cable receiving passageway extending through the housing lengthwise thereof and having an entry end and an exit end, a second relatively short cable receiving passageway extending through the housing and having an entry end and an exit end, the central longitudinal axis of said second passageway intersecting the central axis of said first passageway, a first slot-like opening formed in said housing and defined by walls which merge with said exit end of the first passageway and also with said entry end of the second passageway, and a second slot-like opening formed in the periphery of the housing and communicating with said second passageway;

a rotary plug rotatably housed within said housing and having a stepped through-bore, said through-bore forming part of said second passageway and being arranged to anchor the trailing end of the cable when fed therethrough, whereby, in use, the cable can be fed through said first opening into the second passageway, through the bore of the plug and out through said second opening, in turn passed along the first passageway and finally out through said first opening, wherein a portion of the cable extending out of said first passageway and said first opening at least partially covers the trailing end of the cable:

movable clamping means housed within the housing for releasably clamping a portion of the cable located within said first passageway; and a lock rotatably supported by the housing and operable to effect movement of said clamping means wherein the cable can be withdrawn from said first passageway, and subsequently from said second passageway, when said movable clamping means releases the cable, whereby the cable is capable of being detached from said device while said device remains intact.

15. The portable looped cable locking device according to claim 14, wherein said lock is rotated by a key insertable into the lock.

16. The portable looped cable locking device according to either claim 14 or 15, wherein said second slot-like opening merges with a grooved peripheral portion which extends along a side of the housing.

17. The portable looped cable locking device according to claim 14, wherein said first passageway is at right angles to said second passageway.

* * * * *